US010808206B2

(12) United States Patent
Pelletier et al.

(10) Patent No.: US 10,808,206 B2
(45) Date of Patent: Oct. 20, 2020

(54) DETERGENT BOOSTERS, DETERGENT SYSTEMS THAT INCLUDE A DETERGENT BOOSTER, AND METHODS OF LAUNDERING FABRIC

(71) Applicant: Henkel IP & Holding GmbH, Duesseldorf (DE)

(72) Inventors: Maxime Pelletier, Sandy Hook, CT (US); Paul Kichar, Oxford, CT (US); Alma Calderon, Derby, CT (US)

(73) Assignee: Henkel IP & Holding GmbH (DE)

( * ) Notice: Subject to any disclaimer, the term of this patent is extended or adjusted under 35 U.S.C. 154(b) by 19 days.

(21) Appl. No.: 15/811,775

(22) Filed: Nov. 14, 2017

(65) Prior Publication Data

US 2019/0144787 A1 May 16, 2019

(51) Int. Cl.

| | |
|---|---|
| ***C11D 3/37*** | (2006.01) |
| ***C11D 1/74*** | (2006.01) |
| ***C11D 17/04*** | (2006.01) |
| ***C11D 3/00*** | (2006.01) |
| ***C11D 11/00*** | (2006.01) |

(52) U.S. Cl.

CPC ..... *C11D 3/3715* (2013.01); *C11D 1/74* (2013.01); *C11D 3/0036* (2013.01); *C11D 11/0017* (2013.01); *C11D 17/041* (2013.01)

(58) Field of Classification Search

CPC ..... C11D 3/3715; C11D 3/0036; C11D 1/74; C11D 11/0017; C11D 17/041

See application file for complete search history.

(56) References Cited

U.S. PATENT DOCUMENTS

| | | | | |
|---|---|---|---|---|
| 3,959,230 | A | 5/1976 | Hays | |
| 4,702,857 | A | 10/1987 | Gosselink | |
| 4,999,128 | A * | 3/1991 | Sonenstein | C08G 63/672 510/299 |
| 5,786,318 | A * | 7/1998 | Blokzijl | C08G 63/668 510/299 |
| 8,158,571 | B2 | 4/2012 | Alonso et al. | |
| 8,846,599 | B2 | 9/2014 | Haberecht et al. | |
| 8,901,066 | B2 | 12/2014 | Haberecht et al. | |
| 9,365,806 | B2 | 6/2016 | Carswell et al. | |
| 9,422,509 | B2 | 8/2016 | Meier et al. | |
| 2006/0073994 | A1 | 4/2006 | Hage et al. | |
| 2009/0036641 | A1 | 2/2009 | Lang et al. | |
| 2010/0311637 | A1 | 12/2010 | Alonso et al. | |
| 2011/0112005 | A1* | 5/2011 | Brooker | C11D 1/29 510/321 |
| 2012/0322714 | A1 | 12/2012 | Haberecht et al. | |
| 2012/0322950 | A1 | 12/2012 | Haberecht et al. | |
| 2013/0000052 | A1 | 1/2013 | Peeters et al. | |
| 2015/0005220 | A1 | 1/2015 | Meier et al. | |
| 2015/0166938 | A1 | 6/2015 | Fischer et al. | |
| 2015/0203630 | A1 | 6/2015 | Fischer et al. | |
| 2015/0210961 | A1 | 7/2015 | Carswell et al. | |
| 2017/0137755 | A1 | 5/2017 | Carswell et al. | |

FOREIGN PATENT DOCUMENTS

| | | | |
|---|---|---|---|
| EP | 0271312 | A2 | 6/1988 |
| EP | 0839899 | A1 | 5/1998 |
| EP | 2135931 | A1 | 12/2009 |
| EP | 2987848 | A1 | 2/2016 |
| EP | 3441451 | A1 | 2/2019 |
| GB | 2296261 | A | 6/1996 |
| JP | 2014-009235 | * | 1/2014 |
| WO | 9419448 | A1 | 9/1994 |
| WO | 9621715 | A1 | 7/1996 |
| WO | 2009115379 | A1 | 9/2009 |
| WO | 2012104157 | A1 | 8/2012 |
| WO | 2012104158 | A1 | 8/2012 |
| WO | 2012104159 | A1 | 8/2012 |
| WO | 2013092052 | A1 | 6/2013 |
| WO | 2013185346 | A1 | 12/2013 |
| WO | 2014019658 | A1 | 2/2014 |
| WO | 2014019659 | A1 | 2/2014 |
| WO | 2015091009 | A1 | 6/2015 |
| WO | 2016075178 | A1 | 5/2016 |

OTHER PUBLICATIONS

Extended EP Search Report EP 18204052.7 Completed: Apr. 4, 2019 dated Apr. 12, 2019 8 pages.

Extended EP Search Report EP 18204052.7 dated May 12, 2020 9 pages.

* cited by examiner

*Primary Examiner* — Amina S Khan

(74) *Attorney, Agent, or Firm* — Bojuan Deng

(57) ABSTRACT

Detergent boosters, detergent systems that include a detergent booster, and methods of laundering fabric are provided herein. In an embodiment, a detergent booster includes a nonionic soil release polymer and, optionally, one or more surfactants with a total amount of surfactant present in an amount of up to 4 weight % based upon a total weight of the detergent booster. The nonionic soil release polymer includes a backbone having ester linkages.

12 Claims, 4 Drawing Sheets

DETERGENT BOOSTERS, DETERGENT SYSTEMS THAT INCLUDE A DETERGENT BOOSTER, AND METHODS OF LAUNDERING FABRIC

TECHNICAL FIELD

The technical field generally relates to detergent boosters, detergent systems that include detergent booster, and methods of laundering fabric, and more particularly relates to detergent boosters, detergent systems that include detergent booster, and methods of laundering fabric to remove or prevent deposition of oily substances from fabrics.

BACKGROUND

Soil release polymer (SRP) is a multifunctional polymer with a molecular structure that is similar to various polyester materials that are widely used in fabrics, such as for athleisure and athletic clothing. SRPs are often employed in detergent compositions to enhance removal of oily stains from fabrics, and the SRPs are particularly effective for removal of oily stains from polyester materials. The SRPs generally function by depositing onto a surface of fibers in the fabric, providing a protective or sacrificial layer that inhibits adhesion of oily substances onto the fibers.

Human sebum is one type of oily substance that is often difficult to remove from fabrics, especially polyester materials. Sebum deposits that are formed on the fabrics through buildup of the sebum over time result in corresponding development of persistent odor due to autoxidation of the sebum deposits. The persistent odor develops due to combined action of sweat, sebum, and bacteria, as the sebum acts as a food source for the bacteria. Sebum deposits are difficult to remove, even after repeated washings. Sebum deposits are particularly prevalent in athleisure and athletic clothing due to the manner in which such articles of clothing are generally employed.

SRPs are known for use in laundry detergents and fabric softening compositions. When employed in laundry detergents, the SRPs are introduced during a wash cycle along with other components that perform cleaning functions (e.g., high amounts of various surfactants, detergent builders, and the like). When employed in fabric softening compositions, the SRPs are introduced during a rinse cycle, i.e., in a separate and later cycle from the wash cycle during which the laundry detergent is present. The SRPs in the fabric softening compositions are included with fabric softening quaternary ammonium compounds, as well as with high amounts of surfactant. The SRPs are generally effective when employed in the laundry detergents and the fabric softeners, and nonionic SRPs are generally compatible with various surfactant systems. However, efforts have been made to optimize amounts of nonionic, anionic, and/or cationic surfactants in the laundry detergents to balance impact of the surfactant mix on the SRPs with laundering effectiveness. Despite such efforts to optimize the amounts of nonionic, anionic, and/or cationic surfactants in the laundry detergents, laundering effectiveness of the surfactant mix is inferior to surfactant mixes that do not include to the SRPs due to the modifications made to minimize the impact of the surfactant mix on the SRPs.

Accordingly, it is desirable to provide compositions, systems, and methods to improve the effectiveness of SRPs for purposes removing or preventing deposition of oily substances on fabrics. Furthermore, other desirable features and characteristics will become apparent from the subsequent detailed description and the appended claims, taken in conjunction with the accompanying drawings and this background.

BRIEF SUMMARY

Detergent boosters, detergent systems that include a detergent booster, and methods of laundering fabric are provided herein. In an embodiment, a method of laundering fabric includes combining wash water, a laundry detergent, optionally a detergent booster separate from the laundry detergent, and the fabric in a wash basin to form a wash solution. The detergent booster includes a nonionic soil release polymer and, optionally, one or more surfactants with a total amount of surfactant present in an amount of up to 4 weight % based upon a total weight of the detergent booster. The nonionic soil release polymer includes a backbone having ester linkages. The laundry detergent includes one or more surfactants and a detergent builder. The surfactant(s) are present in the laundry detergent in an amount of at least 4 weight %, based upon the total weight of the laundry detergent. The fabric is agitated in the wash solution, and the wash solution is drained from the wash basin. The fabric is rinsed in the wash basin with rinse water and, optionally, with a fabric conditioner, the detergent booster, or both, after draining the wash solution from the wash basin. In a preferred embodiment, the detergent booster is included both in the wash solution and during rinsing. The booster may be in liquid form or solid form. When it is in liquid form, water or other organic solvent(s) may be a carrier. When it is in solid form, a salt or sugar base may be a carrier.

In another embodiment, a method of laundering fabric includes combining wash water, a laundry detergent, and the fabric in a wash basin to form a wash solution. The laundry detergent includes one or more surfactants and a detergent builder. The surfactant(s) are present in the laundry detergent in an amount of at least 4 weight %, based upon the total weight of the laundry detergent. The fabric is agitated in the wash solution, and the wash solution is drained from the wash basin. The fabric is rinsed in the wash basin with rinse water, a fabric conditioner, and a detergent booster, after draining the wash solution from the wash basin. The detergent booster includes a nonionic soil release polymer and, optionally, one or more surfactants with a total amount of surfactant present in an amount of up to 4 weight % based upon a total weight of the detergent booster. The nonionic soil release polymer includes a backbone having ester linkages.

In another embodiment, a detergent booster includes a nonionic soil release polymer, water, and optionally one or more surfactants. The nonionic soil release polymer includes a backbone having ester linkages. Water is present in an amount of at least about 50 weight % water, based upon a total weight % of the detergent booster. The surfactant(s) are present in an amount of up to 4 weight % based upon a total weight of the detergent booster. The detergent booster is substantially free of quaternary ammonium compounds.

In another embodiment, a detergent system includes a laundry detergent and a detergent booster packaged separate from the laundry detergent. The laundry detergent includes one or more surfactants and a detergent builder. The surfactant(s) are present in an amount of at least 4 weight %, based upon the total weight of the laundry detergent. The detergent booster includes a nonionic soil release polymer and, optionally, one or more surfactants with a total amount of surfactant present in an amount of up to 4 weight % based upon a total weight of the detergent booster. The nonionic soil release polymer includes a backbone having ester linkages. The detergent booster is substantially free of quaternary ammonium compounds.

BRIEF DESCRIPTION OF THE DRAWINGS

The various embodiments will hereinafter be described in conjunction with the following drawing figures, wherein like numerals denote like elements, and wherein.

DETAILED DESCRIPTION

Figure 1:
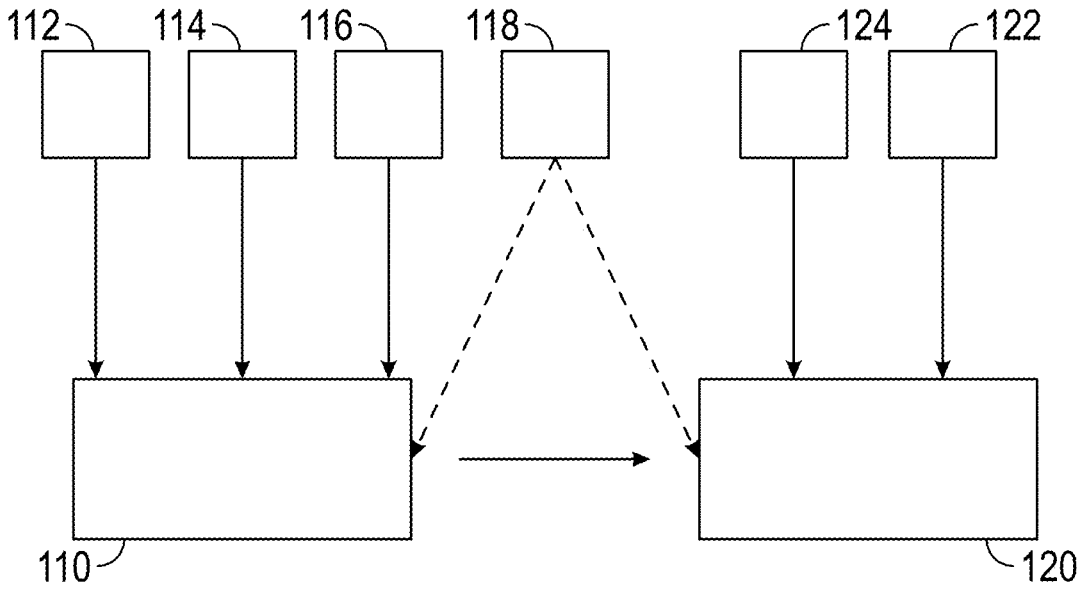
FIG. 1 schematically illustrates a method of laundering fabric accordance with an embodiment.

Detergent boosters, detergent systems that include a detergent booster, and methods of laundering fabric are provided herein. The following detailed description is merely exemplary in nature and is not intended to limit the detergent boosters, detergent systems that include the detergent booster, and methods of laundering fabric as described herein. Furthermore, there is no intention to be bound by any theory presented in the preceding background or the following detailed description.

The detergent boosters include a nonionic soil release polymer (SRP) and, optionally, one or more surfactants with a total amount of surfactant present in an amount of up to 4 weight % based upon a total weight of the detergent booster. As referred to herein, "detergent booster" is an additive formulated to supplement laundry detergent during a wash cycle and/or a rinse cycle of a laundering process. In embodiments, the detergent booster is formulated to supplement the laundry detergent during the wash cycle only. In other embodiments, the detergent booster is formulated to add during the rinse cycle only. The detergent booster is not, itself, a laundry detergent and is not formulated as a stand-alone composition useful as a laundry detergent during a wash cycle of the laundering process due to the low amount of surfactant present therein, when surfactant is present at all. The detergent systems, in addition to the detergent booster, include a laundry detergent that includes one or more surfactant(s) present in an amount of at least 4 weight %, based upon the total weight of the laundry detergent, with the detergent booster maintained physically separate from the laundry detergent. In accordance with an exemplary method of laundering, as contemplated herein, wash water, the laundry detergent, the detergent booster, and the fabric are combined in a wash basin to form a wash solution. It is also to be appreciated that the detergent booster may be introduced during the rinse cycle. By maintaining the detergent booster physically separate from the laundry detergent, it is believed that greater effectiveness of the SRPs is attained because premature contact of the SRPs with high amounts of surfactant of the laundry detergent is avoided. Further, it was found that presence of the SRPs with the high amounts of surfactant in the wash solution does not negatively impact effectiveness of the SRPs when the SRPs are maintained physically separate from the laundry detergent during storage. Further still, pH also impacts effectiveness of the SRPs, with high pH values such as pH of 8 or greater promoting hydrolysis of ester groups that are often present in SRPs. Thus, by maintaining the detergent booster physically separate from the laundry detergent, conventional laundry detergents can be employed with high surfactant content without consideration of optimizing amounts of nonionic, anionic, and/or cationic surfactants to balance laundering effectiveness with impact of the surfactant mix on the SRPs. Further, as many laundry detergents have pH values of greater than 8, excessive hydrolysis of the SRPs can be avoided by maintaining the detergent booster physically separate from the laundry detergent.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

An exemplary detergent booster will now be described. The detergent booster, as contemplated herein, includes a nonionic SRP, water, and, optionally, one or more surfactants with a total amount of surfactant present in an amount of up to 4 weight % based upon a total weight of the detergent booster, among other optional components. The detergent booster effectively provides a vehicle for introducing the SRP into the wash cycle, separate from the laundry detergent, and/or into the rinse cycle with a minimal, if any, content of surfactant present along with the SRP. The detergent booster minimizes exposure of the SRP to high surfactant amounts until mixing with the laundry detergent. In this regard, the detergent booster may include the surfactant in an amount of up to (but not including) 4 weight %, such as from greater than 0 to less than 4 weight %, such as from about 0.5 to less than 4 weight %, or such as from about 2 to less than 4 weight %, based upon a total weight of the detergent booster. In embodiments, the detergent booster is substantially free of surfactant. By "substantially free," it is meant that the subject component is present in an amount of less than about 1 weight %, such as less than about 0.02 weight %, or such as an amount that is below detectable limits of conventional diagnostic equipment (e.g., spectrophotometers).

Various surfactants may be suitable for the detergent boosters as contemplated herein. In embodiments, the detergent booster includes one or more nonionic surfactants. Examples of suitable nonionic surfactants include, but are not limited to, those chosen from polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, alkoxylated fatty alcohols, ethylene oxide (EO)-propylene oxide (PO) block polymers, or combinations thereof. In embodiments, the nonionic surfactant includes one or more polyoxyalkylene sorbitan fatty acid ester. The polyoxyalkylene sorbitan fatty acid ester can be, for example, ethoxylated and/or propoxylated with the resulting polyoxyalkylene sorbitan fatty acid ester having from 5 to about 50 alkyleneoxy groups, such as from about 15 to about 25 alkyleneoxy groups. The sorbitan fatty acid esters can be, for example, one or more of a monolaurate, a monopalmitate, a monostearate, or a monooleate. One specific example of a suitable nonionic surfactant is PEG-80 sorbitan laurate. In embodiments, the detergent booster may include other types of surfactant instead of or in addition to the nonionic surfactant, such as anionic surfactants, cationic surfactants, and/or zwitterionic surfactants. Examples of suitable anionic surfactants are described below. Conventional cationic surfactants and zwitterionic surfactants known for use in detergent applications may be employed.

Water is generally present in the detergent booster as a predominant component of the detergent booster. In embodiments, the water is present in an amount of at least about 50 weight %, such as at least 80 weight %, or such as from about 80 to about 99 weight %, based upon a total weight of the detergent booster.

The nonionic SRP that is included in the detergent booster has a backbone, i.e., a main polymer chain, having ester linkages. Nonionic SRPs generally include both hydrophilic segments, which hydrophilize the surface of hydrophobic fibers such as polyester and nylon, and hydrophobic segments, which deposit upon hydrophobic fibers and remain adhered thereto through completion of washing and rinsing cycles to serve as an anchor for the hydrophilic segments. Such features of the nonionic SRPs can enable stains occurring subsequent to laundering to be more easily cleaned in subsequence laundering processes.

In embodiments, the nonionic SRP includes the reaction product of an unsulphonated diacidic monomer and a sulphonated diacidic monomer. Examples of unsulfonated diacidic monomers include, for example, dicarboxylic acid or anhydride chosen from terephthalic, isophthalic and 2,6 naphthalenedicarboxylic acids or anhydrides or their diesters. In embodiments, the unsulphonated diacidic monomer may include from about 50 to 100 mole %, such as from about 70 to 90 mole %, of terephthalic acid or anhydride or lower alkyl (methyl, ethyl, propyl, isopropyl, butyl) diester, and from 0 to about 50 mole %, such as from about 10 to about 30 mole %, of isophthalic acid or anhydride and/or of 2,6-naphthalenedicarboxylic acid or anhydride or lower alkyl (methyl, ethyl, propyl, isopropyl, butyl) diester.

The sulphonated diacidic monomer has at least one sulphonic acid group, which may be in the form of an alkali metal (e.g., sodium) sulphonate, and two acidic functional groups or acidic functional group equivalents (i.e., an anhydride functional group or two ester functional groups) attached to one or more aromatic rings, when aromatic dicarboxylic acids or anhydrides or their diesters are involved, or to an aliphatic chain when aliphatic dicarboxylic acids or anhydrides or their diesters are involved. Suitable aromatic sulphonated diacidic monomers include, for example, sulphoisophthalic, sulphoterephthalic, sulpho-ortho-phthalic acids or anhydrides, 4-sulpho-2,7-naphthalenedicarboxylic acids or anhydrides, sulpho 4,4'-bis (hydroxycarbonyl) diphenyl sulphones, sulphodiphenyldicarboxylic acids or anhydrides, sulpho 4,4'-bis(hydroxycarbonyl) diphenylmethanes, sulpho-5-phenoxyisophthalic acids or anhydrides or their lower (methyl, ethyl, propyl, isopropyl, butyl) diesters. Suitable aliphatic sulphonated diacidic monomers (SA) include sulphosuccinic acids or anhydrides or their lower alkyl (methyl, ethyl, propyl, isopropyl, butyl) diesters. In embodiments, the sulphonated diacidic monomer (SA) is sulphoisophthalic acid in acid, anhydride or diester (preferably dimethyl ester) form.

In embodiments, the nonionic SRP further includes the reaction product of alkyl-capped polyalkylene glycol, e.g., methyl-capped polyethylene glycol or methyl-capped propylene glycol, in addition to the reaction product of the unsulphonated diacidic monomer and the sulphonated diacidic monomer. In alternative embodiments, the nonionic SRP may include the reaction product of the alkyl-capped polyalkylene glycol and the unsulphonated diacidic monomer, in the absence of sulphonated diacidic monomer. In embodiments, the alkyl-capped polyalkylene glycol may have from about 1 to about 120 units of polyalkylene glycol, such as from about 10 to about 50 units of polyalkylene glycol per molecule. In alternative embodiments, the polyesters may be prepared by heating dimethyl terephthalate (DMT), 1,2-propylene glycol (PG), and $H_3C(OC_2H_4)_n$—$(OC_3H_6)_m$—OH, wherein the —$(OC_2H_4)$ groups and the —$(OC_3H_6)$ groups are arranged blockwise and the block including —$(OC_3H_6)$ groups is bound to the hydroxyl group —OH, n is based on a molar average a number of from 44 to 46, m is based on a molar average 5, with the addition of a catalyst, to temperatures of from 160 to 220 C, firstly at atmospheric pressure, and then continuing the reaction under reduced pressure at temperatures of from 160 to 240° C. Nonionic SRPs have the aforementioned chemistries are commercially available from Clariant International, Inc. of Muttenz, Switzerland under the tradename Texcare®.

In embodiments, the nonionic SRPs are present in the detergent booster in an amount of from about 2 to about 10 weight %, such as from about 3 to about 7 weight %, based upon the total weight of the detergent booster.

The detergent booster is generally free from substantial amounts of additional components beyond those described above. For example, in embodiments, the detergent booster has less than about 10 weight %, such as less than about 6 weight %, of additional components other than the water, any optional surfactant(s), and the nonionic SRP, wherein the amount is based upon the total weight of the detergent booster. Additional components that may be included in the detergent booster, albeit in a combined amount of less than about 10 weight %, include, for example, fragrances (both free and encapsulated fragrances), neutralizing agents such as triethylenediamine, colorants, preservatives, thickeners, as well as other conventional additives that do not fall under the categories of nonionic surfactant or nonionic SRP and that are traditionally employed in laundering applications.

In embodiments, the detergent booster has a pH of less than 8, such as from about 3 to less than 8, or such as from about 5.2 to about 7.8. It is believed that the relatively neutral pH values of the detergent booster deter degradation of the SRPs by minimizing hydrolysis of ester groups that may be present in the SRPs as compared to formulations having pH values of 8 or greater.

An exemplary embodiment of a detergent system includes the detergent booster and a laundry detergent, with the detergent booster packaged separate from the laundry detergent. The laundry detergent and the detergent booster may be marketed as a unitary product, or may be marketed separately with instruction to consumers for employing the laundry detergent and the detergent booster together. In embodiments, the laundry detergent includes one or more surfactants and a detergent builder, and may optionally include further components that are traditionally included in laundry detergents. Additionally, the laundry detergent may be a commercially available formulation. The laundry detergent is distinguished from the detergent booster at least by way of the inclusion of higher amounts of surfactant therein as compared to the detergent booster. The laundry detergent may also be distinguishable from the detergent booster on the basis of pH, with the detergent booster having a lower pH than laundry detergent. Additionally, the laundry detergent may be in a liquid, granular, or tableted form (under ambient temperatures and pressures), whereas the detergent booster is generally in liquid form due to the water content thereof.

Any conventional surfactant can be included in the laundry detergent, such as any combination of anionic, cationic, nonionic, and/or zwitterionic surfactants. For example, suitable anionic surfactants include those surfactants that contain a long chain hydrocarbon hydrophobic group in their molecular structure and a hydrophilic group, i.e., water solubilizing group including salts such as carboxylate, sulfonate, sulfate or phosphate groups. Suitable anionic surfactant salts include sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group. Examples of such anionic surfactants include water soluble salts of alkyl benzene sulfonates having between 8 and 22 carbon atoms in the alkyl group, alkyl ether sulfates having between 8 and 22 carbon atoms in the alkyl group.

The surfactant(s) are included in the laundry detergent in an amount of at least 4 weight %, such as from about 4 to about 70 weight %, or such as from about 5 to about 40 weight %, based upon the total weight of the laundry detergent.

Any conventional detergent builder may be included in the laundry detergent. Examples of suitable detergent builders include, but are not limited to, citric acid, sodium hydroxide, sodium carbonate, sodium bicarbonate, calcium chloride, triethanolamine, monoethanolamine, aluminosilicates, sodium silicate, sodium orthophosphate, pyrophosphate, tripolyphosphate, and mixtures thereof.

An exemplary method of laundering fabric using the detergent booster will now be described with reference to FIG. 1. In an embodiment, wash water 112, the laundry detergent 114, the detergent booster 118, and fabric 116 are combined in a wash basin to form a wash solution, as illustrated at wash cycle 110 in FIG. 1. The wash basin, as referred to herein, may be any vessel capable of retaining the wash solution and fabrics 116 to be laundered. In embodiments, the wash basin is a basin of a washing machine, although it is to be appreciated that the wash basin may be a laundry tub, a bucket, or the like. The detergent booster 118 is packaged separate from the laundry detergent 114. In embodiments, the laundry detergent 114 and the detergent booster 116 are maintained separate, and remain as such, until both the laundry detergent 114 and the detergent booster 118 are introduced into and combined in the wash basin. However, it is to be appreciated that in other embodiments, the laundry detergent 114 and the detergent booster 118 may be combined shortly prior to introduction in the wash basin, e.g., within 30 minutes of introduction into the wash basin. In embodiments, the laundry detergent 114, the detergent booster 118, and the fabric 116 are all physically separate prior to combining in the wash basin, with no pre-mixing of any of the aforementioned components outside of the wash basin. Alternatively, in other embodiments, two or more of the wash water 112, the laundry detergent 114, the detergent booster 118, or the fabric 116 are combined prior to combining the remaining of the wash water 112, the laundry detergent 114, the detergent booster 118, or the fabric 116. The fabric 116 is agitated in the wash solution consistent with conventional laundering techniques. Agitation may be conducted either manually, e.g., by operation of human hands, or mechanically, e.g., by operation of an agitator of a conventional washing machine. After washing for a period of time, the wash solution is drained from the wash basin. The fabric 116 is rinsed in the wash basin with rinse water 122 after draining the wash solution from the wash basin, as illustrated at rinse cycle 120 in FIG. 1. Optionally, a fabric conditioner 124 that includes quaternary ammonium may be introduced during the rinse cycle 120. In embodiments, multiple cycles 120 of rinsing and draining may be conducted. In another embodiment and as also shown in FIG. 1, the detergent booster 118 is introduced during the rinse cycle 120, either in addition to or as an alternative to introducing the detergent booster 118 during the wash cycle 110.

As illustrated by the Examples, greater reduction of oily substance deposits on fabrics, especially polyester fabrics such as 100% polyester or polyester blends, is achieved by employing the detergent booster in accordance with the above-described method of laundering as compared to laundering the fabric with comparative laundry detergent including equivalent amounts of SRP as the amount of SRP introduced in the detergent booster. Additionally, such results can be achieved without lowering amounts of surfactant provided during the wash cycle, leading to excellent laundering effectiveness of the detergent system.

Additionally, the Examples show that, unexpectedly, the inclusion of the detergent booster in the rinse cycle along with a liquid fabric conditioner greatly reduces the build-up of sebum while allowing the fabric to remain soft. It has been noticed that while a fabric conditioner provides softness to a fabric, it also undesirably increases sebum odor on fabric. Without wishing to be bound by theory, it is believed that common ingredients in the fabric conditioner that stay on the fabric after wash and rinse so as to keep the fabric remaining soft during wearing also have a tendency to attract sebum odor, causing more sebum build-up. The inclusion of the detergent booster of the present invention in the rinse cycle along with a liquid fabric conditioner provides a solution to the problem.

The following Examples are intended to supplement the present disclosure and are not to be interpreted as limiting the subject matter as contemplated herein.

EXAMPLES

Various detergent boosters including different soil release polymers (SRPs) were tested for effectiveness in regards to sebum removal. Additionally, laundry detergents themselves were tested, along with fabric softeners that were employed to illustrate comparative effectiveness of the SRPs in the detergent boosters as compared to other delivery vehicles. Detergent boosters were prepared as set forth in TABLE I, with all amounts in weight % based upon the total weight of the detergent booster on an actives basis (Wt. % Active) and on a total weight basis (W/W %) to account for the presence of water, other solvents, fillers, and the like that may be present with the component that is included in the detergent booster prior to mixing.

TABLE I

| | Ex. 1 | | Ex. 2 | | Ex. 3 | | Ex. 4 | |
|---|---|---|---|---|---|---|---|---|
| | Wt. % Active | W/W % | Wt. % Active | W/W % | Wt. % Active | W/W % | Wt. % Active | W/W % |
| Water | 88.62 | 78.11 | 88.62 | 75.06 | 88.62 | 78.98 | 88.62 | 76.89 |
| Surfactant A | 2.50 | 3.50 | 2.50 | 3.50 | 2.50 | 3.50 | 2.50 | 3.50 |
| SRP A | 3.65 | 6.08 | 0.00 | 0.00 | 0.00 | 0.00 | 0.00 | 0.00 |
| SRP B | 0.00 | 0.00 | 3.65 | 9.13 | 0.00 | 0.00 | 0.00 | 0.00 |
| SRP C | 0.00 | 0.00 | 0.00 | 0.00 | 3.65 | 5.21 | 0.00 | 0.00 |
| SRP D | 0.00 | 0.00 | 0.00 | 0.00 | 0.00 | 0.00 | 3.65 | 7.30 |
| Additive A | 0.27 | 0.27 | 0.27 | 0.27 | 0.27 | 0.27 | 0.27 | 0.27 |
| Additive B | 0.49 | 1.63 | 0.49 | 1.63 | 0.49 | 1.63 | 0.49 | 1.63 |
| Additive C | 0.23 | 0.27 | 0.23 | 0.27 | 0.23 | 0.27 | 0.23 | 0.27 |
| Additive D | 0.00 | 0.01 | 0.00 | 0.01 | 0.00 | 0.01 | 0.00 | 0.01 |
| Additive E | 0.13 | 0.13 | 0.13 | 0.13 | 0.13 | 0.13 | 0.13 | 0.13 |
| Fragrance A | 1.70 | 1.70 | 1.70 | 1.70 | 1.70 | 1.70 | 1.70 | 1.70 |
| Fragrance B | 2.41 | 8.30 | 2.41 | 8.30 | 2.41 | 8.30 | 2.41 | 8.30 |
| Total | 100.00 | 100.00 | 100.00 | 100.00 | 100.00 | 100.00 | 100.00 | 100.00 |

Water is distilled water.

Surfactant A is a PEG-80 sorbitan laurate nonionic surfactant.

SRP A is a nonionic polyester that includes the terephthalate groups, 5-sulfoisophthalate groups, ethylene glycol groups, and methyl capped polyethylene glycol groups, with a 60 wt. % active content, 20 wt. % water, and 20 wt. % propylene glycol, commercially available from Clariant International, Inc. of Muttenz, Switzerland.

SRP B is a nonionic polyester of the same formula as SRP A, but with 40 wt. % active and 60 wt. % water, commercially available from Clariant International, Inc.

SRP C is a nonionic polyester that includes —OOC-(1, 4-phenylene)-COO-structural units and —O—CH2CH2-O structural units, with a 70 wt. % active content, commercially available from Clariant International, Inc.

SRP D is a nonionic polyester having the formula:

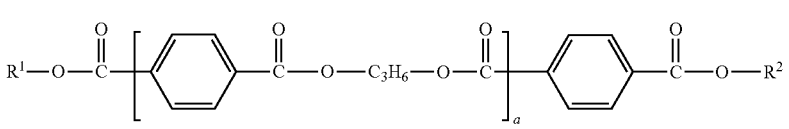

(I)

wherein R1 and R2 independently of one another are X—(OC2H4)n-(OC3H6)m wherein X is methyl, the —(OC2H4) groups and the —(OC3H6) groups are arranged blockwise and the block consisting of the —(OC3H6) groups is bound to a COO group or are HO—(C3H6), and are independently of one another, n is based on a molar average a number of from 40 to 50, m is based on a molar average a number of from 1 to 7, and a is based on a molar average a number of from 4 to 9, with a 50 wt. % active content.

Additive A is a layered silicate commercially available under the tradename Laponite RD from Byk Chemie GmbH of Wesel, Germany.

Additive B is a hydrophobically-modified, alkali-soluble or alkali-swellable emulsion (HASE) thickener.

Additive C is triethanolamine.

Additive D is colorant.

Fragrance A is fragrance oil.

Fragrance B is encapsulated fragrance.

Laundry detergent was prepared as set forth in TABLE II, with all amounts in weight % based upon the total weight of the laundry detergent on an actives basis (Wt. % Active) and on a total weight basis (W/W %) to account for the presence of water, other solvents, fillers, and the like that may be present with the component that is included in the laundry detergent prior to mixing.

TABLE II

| | Laundry Detergent A | |
|---|---|---|
| | Wt. % Active | W/W % |
| Water | 78.95 | 69.86 |
| Citric Acid, 50 wt. % active | 3.25 | 6.50 |
| Sodium Hydroxide, 50 wt. % active | 2.11 | 4.22 |
| Triethanolamine, 85 wt. % active | 0.93 | 1.10 |
| LAS | 1.76 | 1.83 |
| Cocofatty Acid | 0.51 | 0.51 |

TABLE II-continued

| | Laundry Detergent A | |
|---|---|---|
| | Wt. % Active | W/W % |
| Calcium Chloride | 0.05 | 0.05 |
| Additive F | 0.18 | 0.18 |
| Additive G | 6.83 | 6.83 |
| Alcohol Ethoxysulfate, 60 wt. % active | 4.01 | 6.69 |
| Additive H | 0.06 | 0.07 |
| Additive J | 0.25 | 0.56 |
| Iminodisuccinic Acid, 34 wt. % active | 0.25 | 0.74 |
| Additive K | 0.86 | 0.86 |
| Total | 100.00 | 100.00 |

LAS is linear alkylbenzene sulfonate with 96 wt. % active content.

Additive F is a whitening agent commercially available from BASF Corporation of Florham Park, N.J.

Additive G is a nonionic surfactant commercially available from Evonik Industries AG of Parsippany, N.J.

Additive H is an ethoxylated polyethyleneimine commercially available from BASF Corporation.

Additive J is soil release polymer with 45 wt. % active content commercially available as Sokalan® HP20 from BASF Corporation.

Additive K is an enzyme commercially available from Novozymes of Bagsvaerd, Denmark.

Liquid fabric conditioner was prepared as set forth in TABLE III, with all amounts in weight % based upon the total weight of the fabric conditioner on an actives basis (Wt. % Active) and on a total weight basis (W/W %) to account for the presence of water, other solvents, fillers, and the like that may be present with the component that is included in the fabric conditioner prior to mixing.

TABLE III

| | Liquid Fabric Conditioner | |
|---|---|---|
| | Wt. % Active | W/W % |
| Water | 86.13 | 83.72 |
| Additive L | 13.21 | 15.54 |
| Calcium Chloride, 10 wt. % active | 0.49 | 0.49 |
| Lactic Acid, 88 wt. % active | 0.10 | 0.11 |
| Gluteraldehyde, 50 wt. % active | 0.07 | 0.14 |
| Total | 100.00 | 100.00 |

Additive L is a quaternary ammonium compound with 85 wt. % active content, commercially available from Akzo Nobel Surfactants of Chicago, Ill.

To prepare fabric samples for testing, three different types of fabric were employed as follows:

Polyester fabric including 100% polyester material;

Polyester/cotton blend fabric including 50 weight % polyester material and 50 weight % cotton, wherein the weight percentages are based upon the total weight of the fabric;

Polyester/spandex blend fabric including 84 weight % polyester and 16 weight % Spandex, wherein the weight percentages are based upon the total weight of the fabric;

A laundry detergent that includes SRP D was prepared for comparative purposes, and the laundry detergent included the components as set forth in TABLE IV below.

TABLE IV

| | Comp. Ex. 1 | |
|---|---|---|
| | Wt. % Active | W/W % |
| Laundry Deterg. A | 98.42 | 96.84 |
| SRP A | 0.00 | 0.00 |
| SRP B | 0.00 | 0.00 |
| SRP C | 0.00 | 0.00 |
| SRP D | 1.58 | 3.16 |
| Total | 100.00 | 100.00 |

Laundry Detergent A is as described above in TABLE II.

A liquid fabric conditioner that includes SRP B was also prepared for comparative purposes, and the liquid fabric conditioner included the components as set forth in TABLE V below.

TABLE V

| | Comp. Ex. 2 | |
|---|---|---|
| | Wt. % Active | W/W % |
| Liquid Fabric Conditioner | 98.42 | 96.05 |
| SRP A | 0.00 | 0.00 |
| SRP B | 1.58 | 3.95 |
| SRP C | 0.00 | 0.00 |
| SRP D | 0.00 | 0.00 |
| Total | 100.00 | 100.00 |

Liquid Fabric Conditioner is as described above in TABLE III.

All fabric samples are washed three times with control liquid. The wash process was conducted in a Speed Queen top load traditional washing machine with non-chlorinated water at a water temperature at 32.2° C. Consistent, conventional laundry detergent dosages are employed with the water added and agitated for 1 minute prior to adding 2.7 kg of fabric material. The fabric material is washed in a 12 minute wash cycle and a conventional rinse cycle. Baseline images are then taken of the fabric samples using an Antera 3D® camera, commercially available from Mirapex Ltd. of Dublin, Ireland.

A synthetic sebum composition, available as WFK O9D from Testgewebe GmbH of Brueggen, Germany was melted in a hot water bath and sprayed onto the fabric samples in an amount of from about 0.05 to about 0.1 g from a distance of about 35 cm. Images are then taken of the fabric samples after sebum application.

The fabric samples are washed in accordance with the above-described washing conditions, with modifications to the laundry detergent, addition of detergent booster, or use of fabric conditioner during the rinse cycle depending upon the particular testing run conducted. Images of the fabric samples were taken after washing using the Antera 3D® camera. Cycles of sebum application-image capture-wash-image capture are repeated until a total of six cycles are completed. Each cycle may also be called wash cycle. Further, the fabric samples are weighed before and after each application of the six cycles to collect information about the sebum built-up on the fabric samples quantitively.

Because each subsequent cycle includes reapplying sebum composition to the fabric followed by washing the fabric, the wash cycles described herein mimic a real life situation, wherein a person wears a cloth, causing deposition (i.e., build-up) of sebum onto the cloth, and washes the cloth, causing the removal of some or all the sebum from the cloth, followed by additional cycles of wearing and washing the cloth. With more wearing and washing cycles, sebum will tend to partially remain on the clothes after wash. However, it has been discovered that the detergent booster of the present invention effectively and significantly reduces the sebum build-up on the clothes, making the clothes look new and fresh after washes for a longer period of time.

Testing results based upon fabric type, type of SRP used, technology application, and laundry process during which SRP is added are as follows, with determinations made using the images taken of the fabric after the various washing cycles:

Fabric Type:

- Polyester fabric: shows statistically lowest sebum deposition, benefit arises in the third wash cycle;
- Polyester/cotton blend fabric shows statistically lower sebum deposition, benefit arises after three or more wash cycles;
- Polyester/spandex blend shows statistically lower sebum deposition, benefit arises after three or more wash cycles.

SRP Used:

- SRP A: shows statistically highest sebum removal, benefit arises in the third wash cycle;
- SRP B: shows statistically highest sebum removal, benefit arises in the third wash cycle;
- SRP C: shows statistically higher sebum removal, benefit arises in the fourth wash cycle;
- SRP D: shows statistically higher sebum removal, benefit arises in the fourth wash cycle.

Technology Application:

- Detergent booster including SRP (Examples 1-4): shows statistically lowest sebum deposition on fabric, benefit arises in the third wash cycle;
- Liquid detergent including SRP (Comparative Example 1): shows statistically lower sebum deposition on fabric, benefit arises in the third wash cycle;
- Liquid fabric conditioner (Comparative Example 2): shows statistically lower sebum deposition on fabric, benefit arises in the sixth wash cycle.

Laundry Process:

- In-wash: shows statistically lowest sebum deposition on fabric, benefit arises in the third wash cycle;
- In-dry: shows statistically lower sebum deposition on fabric, benefit arises in the third wash cycle;
- Pre-treatment: shows no benefit with one-time pre-treatment, shows benefit with three-time pre-treatment;
- Restoration (6 initial wash/rinse cycles with detergent alone followed by 3 wash/rinse cycles with Laundry Detergent A and Detergent Booster B added during wash cycle): shows statistically lower sebum deposition on fabric, benefit arises in the third wash cycle.

Figure 2:
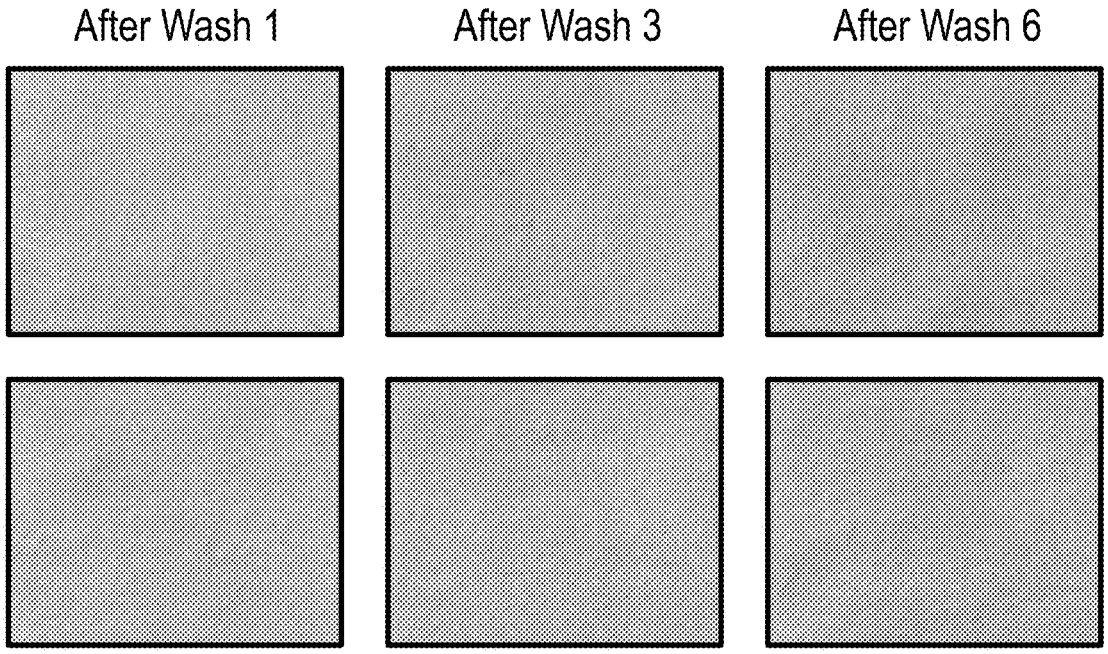
FIG. 2 includes photographs of a stained fabric article (composed of 100% polyester) prior to and after laundering with a top row of images illustrating laundering using laundry detergent alone and with a bottom row of images illustrating laundering using laundry detergent and detergent booster as described herein during a wash cycle, as taken using an Antera 3D® camera.
Figure 3:
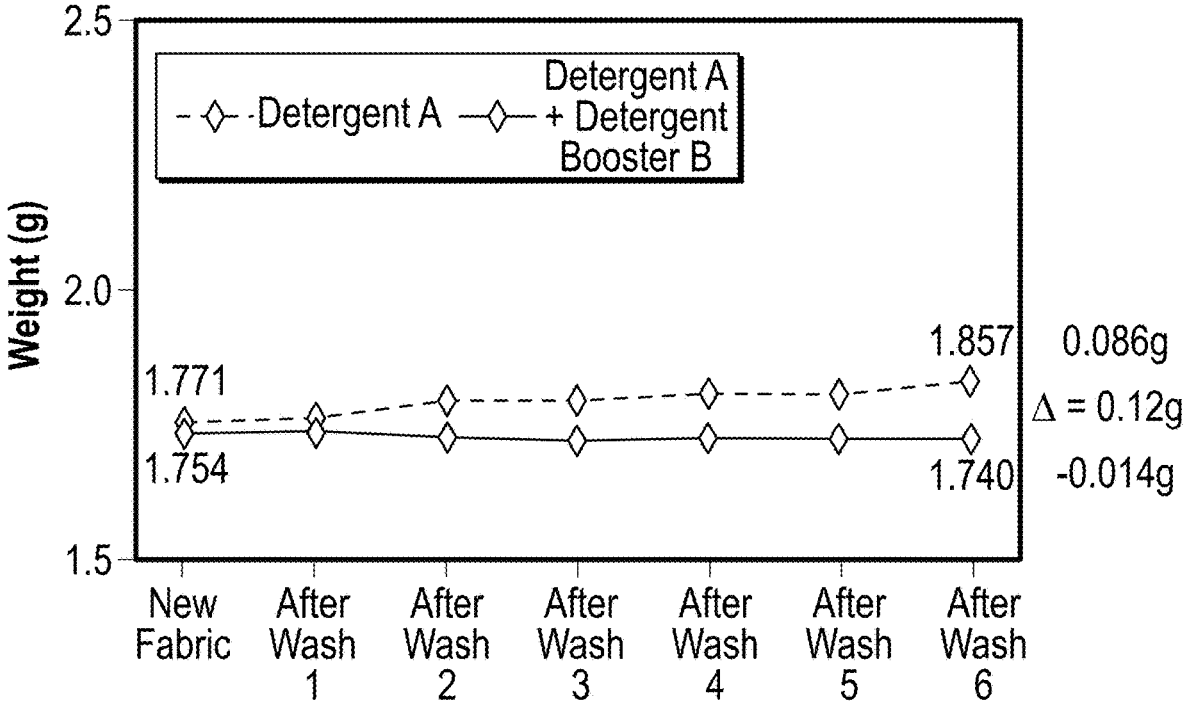
FIG. 3 is a graph showing weight increase of a stained fabric article (composed of 100% polyester) as a result of sebum build-up after washes using Laundry Detergent A or using a combination of Laundry Detergent A and Detergent Booster B.
Figure 4:
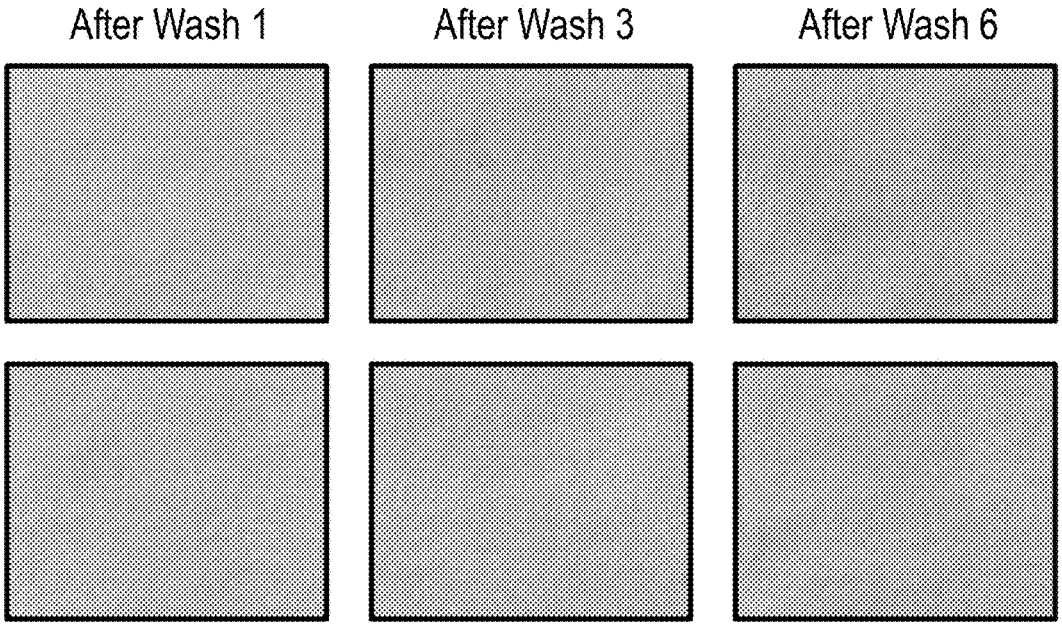
FIG. 4 includes photographs of a stained fabric article (composed of 84% polyester and 16% spandex) prior to and after laundering with a top row of images illustrating laundering using laundry detergent alone and with a bottom row of images illustrating laundering using Laundry Detergent A and Detergent Booster B as described herein during a wash cycle, as taken using an Antera 3D® camera.
Figure 5:
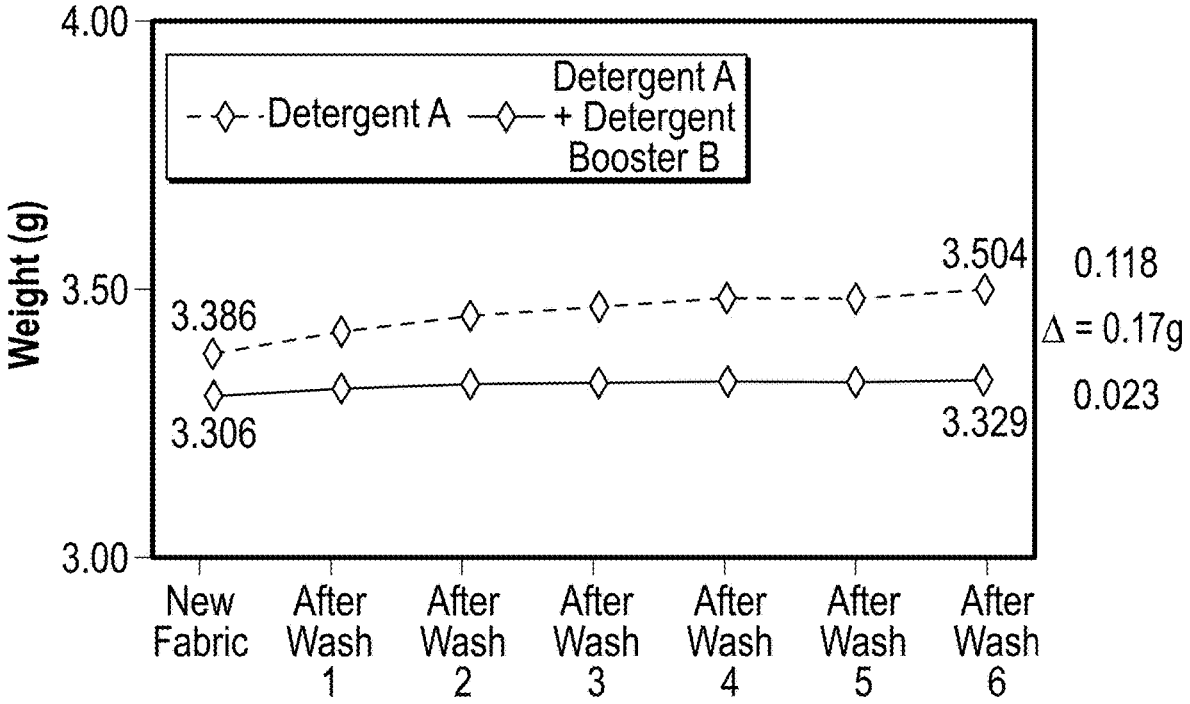
FIG. 5 is a graph showing weight increase of a stained fabric article (composed of 84% polyester and 16% spandex) as a result of sebum build-up after washes using Laundry Detergent A or using a combination of Laundry Detergent A and Detergent Booster B.
Figure 6:
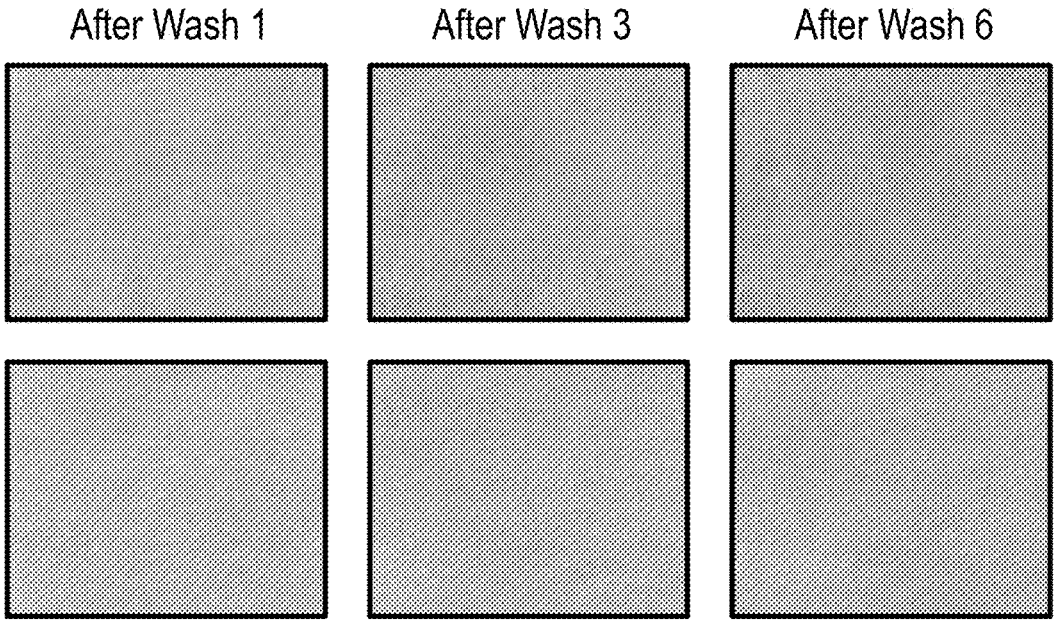
FIG. 6 includes photographs of a stained fabric article (composed of 100% polyester) prior to and after laundering with a top row of images illustrating laundering using Laundry Detergent A alone during a wash cycle and Liquid Fabric Conditioner as set forth above in TABLE III alone during a rinse cycle, and with a bottom row of images illustrating laundering using Laundry Detergent A alone during a wash cycle and Liquid Fabric Conditioner as set forth above in TABLE III and Detergent Booster B as described herein during the rinse cycle, as taken using an Antera 3D® camera.

FIGS. 2, 4, and 6 show images captured using the Antera 3D® camera to illustrate relative sebum build-up after various number of wash cycles. FIGS. 3 and 5 provide a weight analysis after each cycle, which illustrates a direct correlation of sebum build-up on fabric and washes with or without a detergent booster.

Referring to FIG. 2, a top row of images illustrates sebum build-up on 100% polyester fabric after washing using Laundry Detergent A alone (with the images taken after the first wash cycle, the third wash cycle, and the sixth wash cycle, from left to right), and a bottom row of images illustrates sebum build-up on the same fabric after washing using Laundry Detergent A and Detergent Booster B (with the images taken after the first wash cycle, the third wash cycle, and the sixth wash cycle, from left to right). The images show that washing the 100% polyester fabric with a detergent and a detergent booster of the present invention greatly reduces the sebum build-up (i.e., not washable sebum) on the fabric, compared to washing the 100% polyester fabric with a detergent alone. Such effect is more evident after more wash cycles.

FIG. 3 shows the weight increase after each wash, which is caused by the sebum deposited on the fabric but not washable. It clearly shows that washing the 100% polyester fabric with a detergent and a detergent booster of the present invention effectively eliminates or reduces sebum build-up on the fabric—there is almost no weight increases after the 6th wash cycle, as compared to the initial new fabric weight. In contrast, washing the 100% polyester fabric with a detergent alone causes a measurable weight increase of the fabric as a result of non-washable sebum deposition.

FIG. 4 shows images captured using the Antera 3D® camera to illustrate relative sebum build-up on Poly Spandex (composed of 84% polyester and 16% spandex) with the images taken after the $1^{st}$, $3^{rd}$ and $6^{th}$ washes, from left to right, using Laundry Detergent A alone (the top row of images) and using Laundry Detergent A and Detergent Booster B (the bottom row of images). FIG. 5 shows that the weight increase of the Poly Spandex fabric after each wash using Laundry Detergent A or Detergent Booster B is caused by the sebum build-up. Clearly, the use of detergent booster of the present application reduces sebum build-up on Poly Spandex.

Regarding FIG. 6, a top row of images illustrates sebum deposition on 100% polyester fabric after washing using Laundry Detergent A alone and after including the Liquid Fabric Conditioner as set forth above in TABLE III alone, and a bottom row of images illustrates sebum deposition on the same fabric after washing using Laundry Detergent A alone and after including Detergent Booster B in the rinse cycle along with Liquid Fabric Conditioner. The images show that the inclusion of the detergent booster of the present invention in the rinse cycle along with a liquid fabric conditioner greatly reduces the build-up of sebum.

Figure 7:
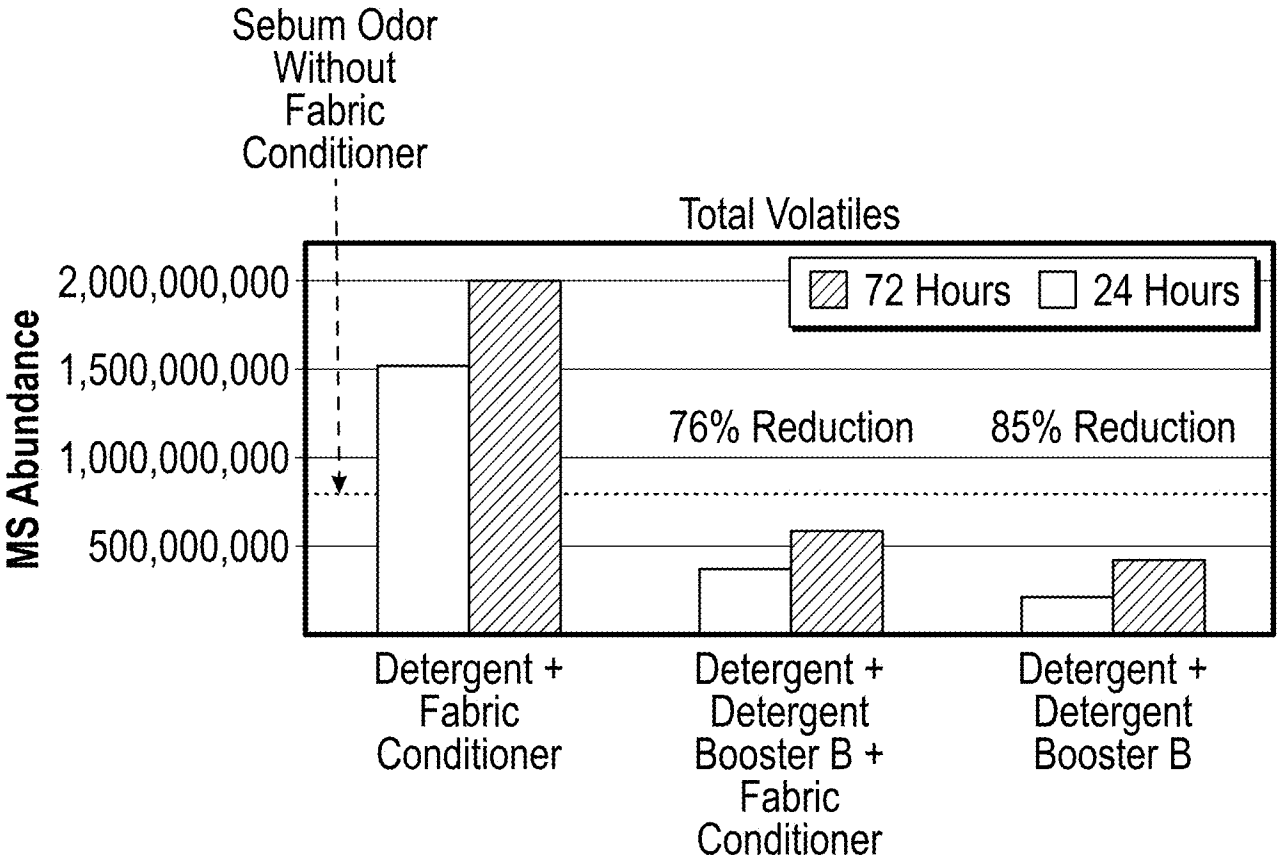
FIG. 7 is a graph showing sebum built-up after using a laundry detergent alone during a wash cycle and a fabric conditioner alone during a rinse cycle, and after using laundry detergent alone during a wash cycle and a fabric conditioner and detergent booster as described herein during the rinse cycle, as measured by a Headspace Analysis.

FIG. 7 shows quantitively the reduction of sebum build-up as a result of using the detergent booster of the present invention in the rinse cycle along with a liquid fabric conditioner. Here, a Headspace Analysis was used to quantify the breakdown (oxidation) of sebum odor (i.e., volatiles such as hexanoic acid, acetic acid, butyric acid, and pentanoic acid) on fabrics, evaluating 24 and 72 hours after the latest wash. The amount of detected total volatiles indicates sebum build-up on fabrics. FIG. 7 shows that washing and rinsing with a liquid fabric conditioner alone led to a large amount of sebum odor on fabrics; washing and rinsing with a detergent booster alone led to 85% reduction of sebum odor on fabrics; and washing and rinsing with a detergent booster and a liquid fabric condition led to 76% reduction of sebum odor on fabrics.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A method of laundering fabric, wherein the method comprises:

combining wash water, a laundry detergent and a detergent booster separate from the laundry detergent, and the fabric in a wash basin to form a wash solution, wherein:

the detergent booster comprises:

from about 2 to about 10 weight % of a nonionic soil release polymer chosen from: the group consisting of a nonionic polyester comprising terephthalate groups, 5-sulfoisophthalate groups, ethylene glycol groups, and methyl capped polyethylene glycol groups, with a 60 wt. % active content, 20 wt. % water, and 20 wt. % propylene glycol;

a nonionic polyester comprising terephthalate groups, 5-sulfoisophthalate groups, ethylene glycol groups, and methyl capped polyethylene glycol groups, with a 40 wt. % active content and 60 wt. % water;

a nonionic polyester comprising —OOC-(1,4-phenylene)-COO— structural units and —O—CH2CH2-O structural units, with a 70 wt. % active content;

a nonionic polyester having the formula:

(I)

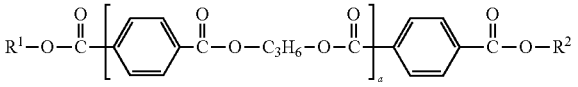

wherein $R^1$ and $R^2$ independently of one another are $X—(OC_2H_4)_n—(OC_3H_6)_m$ wherein X is methyl, the $—(OC_2H_4)$ groups and the $—(OC_3H_6)$ groups are arranged blockwise and the block consisting of the $—(OC_3H_6)$ groups is bound to a COO group or are $HO—(C_3H_6)$, and are independent of one another, wherein n is based on a molar average and is a number of from 40 to 50, m is based on a molar average and is a number of from 1 to 7, and a is based on a molar average and is a number of from 4 to 9, with a 50 wt. % active content; or combinations thereof;

from about 80 to about 90 weight % water, based upon a total weight % of the detergent booster;

a surfactant present in a total amount of from about 0.5 to less than 4 weight % based upon a total weight of the detergent booster; and less than about 10 weight % of additional components other than the water, the surfactant, and the nonionic soil release polymer, wherein the amount is based upon the total weight of the detergent booster wherein the surfactant is chosen from polyoxyalkylene sorbitan fatty acid esters; and wherein the detergent booster wherein the surfactant is chosen from polyoxyalkylene sorbitan fatty acid esters is substantially free of quaternary ammonium compounds; and the laundry detergent comprises:

one or more surfactants present in an amount of at least 4 weight %, based upon the total weight of the laundry detergent; and detergent builder;

agitating the fabric in the wash solution;

draining the wash solution from the wash basin; and rinsing the fabric in the wash basin with rinse water and, optionally, a fabric conditioner, the detergent booster, or both after draining the wash solution from the wash basin;

wherein the detergent booster is included in the wash solution, during rinsing, or both in the wash solution and during rinsing.

2. The method of claim 1, wherein the wash water, the laundry detergent, the detergent booster, and the fabric are all physically separate prior to combining in the wash basin.

3. The method of claim 1, wherein two or more of the wash water, the laundry detergent, the detergent booster, or the fabric are combined prior to combining the remaining of the wash water, the laundry detergent, the detergent booster, or the fabric.

4. The method of claim 1, wherein the laundry detergent and the detergent booster are separately packaged prior to combining in the wash basin, and wherein combining the wash water, the laundry detergent, the detergent booster, and the fabric in the wash basin comprises maintaining the laundry detergent and the detergent booster separate until combining in the wash basin.

5. The method of claim 1, wherein combining the wash water, the laundry detergent, the detergent booster, and the fabric in the wash basin comprises combining the wash water, the laundry detergent, the detergent booster, and polyester fabric in the wash basin in the absence of premixing outside of the wash basin.

6. A detergent booster comprising:

from about 2 to about 10 weight % of a nonionic soil release polymer chosen from: the group consisting of a nonionic polyester comprising terephthalate groups, 5-sulfoisophthalate groups, ethylene glycol groups, and methyl capped polyethylene glycol groups, with a 60 wt. % active content, 20 wt. % water, and 20 wt. % propylene glycol;

a nonionic polyester comprising terephthalate groups, 5-sulfoisophthalate groups, ethylene glycol groups, and methyl capped polyethylene glycol groups, with a 40 wt. % active content and 60 wt. % water;

a nonionic polyester comprising —OOC-(1,4-phenylene)-COO— structural units and $—O—CH_2CH_2—O$ structural units, with a 70 wt. % active content;

a nonionic polyester having the formula:

(I)

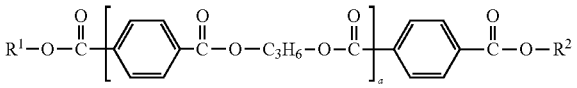

wherein $R^1$ and $R^2$ independently of one another are $X—(OC_2H_4)_n—(OC_3H_6)_m$ wherein X is methyl, the $—(OC_2H_4)$ groups and the $—(OC_3H_6)$ groups are arranged blockwise and the block consisting of the $—(OC_3H_6)$ groups is bound to a COO group or are $HO—(C_3H_6)$, and are independent of one another, wherein n is based on a molar average and is a number of from 40 to 50, m is based on a molar average and is a number of from 1 to 7, and a is based on a molar average and is a number of from 4 to 9, with a 50 wt. % active content; or combinations thereof;

from about 80 to about 90 weight % water, based upon a total weight % of the detergent booster;

a surfactant present in a total amount of from about 0.5 to less than 4 weight % based upon a total weight of the detergent booster wherein the surfactant is chosen from polyoxyalkylene sorbitan fatty acid esters; and less than about 10 weight % of additional components other than the water, the surfactant, and the nonionic soil release polymer, wherein the amount is based upon the total weight of the detergent booster; and wherein the detergent booster is substantially free of quaternary ammonium compounds.

7. The detergent booster of claim 6, having a pH of from about 3 to less than 8.

8. The detergent booster of claim 6, wherein the soil release polymer is a nonionic polyester comprising terephthalate groups, 5-sulfoisophthalate groups, ethylene glycol groups, and methyl capped polyethylene glycol groups, with a 60 wt. % active content, 20 wt. % water, and 20 wt. % propylene glycol.

9. The detergent booster of claim 8 wherein the soil release polymer is included in an amount of 3.65 weight percent actives based on a total weight of the detergent booster.

10. The detergent booster of claim 6, wherein the soil release polymer is a nonionic polyester comprising terephthalate groups, 5-sulfoisophthalate groups, ethylene glycol groups, and methyl capped polyethylene glycol groups, with a 40 wt. % active content and 60 wt. % water.

11. The detergent booster of claim 10 wherein the soil release polymer is included in an amount of 3.65 weight percent actives based on a total weight of the detergent booster.

12. A detergent system comprising:

a laundry detergent comprising:

one or more surfactants present in an amount of at least 4 weight %, based upon the total weight of the laundry detergent; and detergent builder; and a detergent booster packaged separate from the laundry detergent, wherein the detergent booster comprises:

from about 2 to about 10 weight % of a nonionic soil release polymer chosen from: the group consisting of a nonionic polyester comprising terephthalate groups, 5-sulfoisophthalate groups, ethylene glycol groups, and methyl capped polyethylene glycol groups, with a 60 wt. % active content, 20 wt. % water, and 20 wt. % propylene glycol;

a nonionic polyester comprising terephthalate groups, 5-sulfoisophthalate groups, ethylene glycol groups, and methyl capped polyethylene glycol groups, with a 40 wt. % active content and 60 wt. % water;

a nonionic polyester comprising —OOC-(1,4-phenylene)-COO— structural units and —O-CH2CH2-O structural units, with a 70 wt. % active content;

a nonionic polyester having the formula:

(I)

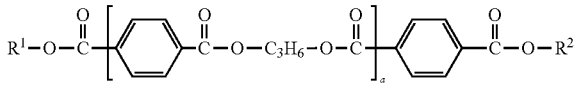

wherein $R^1$ and $R^2$ independently of one another are $X—(OC_2H_4)_n—(OC_3H_6)_m$ wherein X is methyl, the $—(OC_2H_4)$ groups and the $—(OC_3H_6)$ groups are arranged blockwise and the block consisting of the $—(OC_3H)$ groups is bound to a COO group or are $HO—(C_3H_6)$, and are independent of one another, wherein n is based on a molar average and is a number of from 40 to 50, m is based on a molar average and is a number of from 1 to 7, and a is based on a molar average and is a number of from 4 to 9, with a 50 wt. % active content; or combinations thereof;

from about 80 to about 90 weight % water, based upon a total weight % of the detergent booster;

a surfactant present in a total amount of from about 0.5 to less than less than 4 weight %, based upon a total weight of the detergent booster wherein the surfactant is chosen from polyoxyalkylene sorbitan fatty acid esters; and less than about 10 weight % of additional components other than the water, the surfactant, and the nonionic soil release polymer, wherein the amount is based upon the total weight of the detergent booster; and wherein the detergent booster is substantially free of quaternary ammonium compounds.

* * * * *